US011382432B2

(12) United States Patent
Marsden

(10) Patent No.: US 11,382,432 B2
(45) Date of Patent: Jul. 12, 2022

(54) STEP STOOL WITH TREAD

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 153 days.

(21) Appl. No.: 16/571,057

(22) Filed: Sep. 13, 2019

(65) Prior Publication Data

US 2021/0076830 A1 Mar. 18, 2021

(51) Int. Cl.
*A47C 12/00* (2006.01)
*E06C 1/39* (2006.01)

(52) U.S. Cl.
CPC ..... *A47C 12/00* (2013.01); *E06C 1/39* (2013.01)

(58) Field of Classification Search
CPC ..... A47C 12/00; A47D 1/00; A47D 11/00; E06C 1/39; E06C 1/393
See application file for complete search history.

(56) References Cited

U.S. PATENT DOCUMENTS

D216,508 S * 1/1970 Dottinger ..... D6/350
3,599,750 A * 8/1971 Serwer ..... A47C 12/02 182/132
3,721,315 A * 3/1973 Wehner ..... A47C 12/02 182/15
D244,494 S * 5/1977 Dottinger ..... D6/350
D298,674 S * 11/1988 Koller, Sr. ..... D6/336
5,094,505 A * 3/1992 Nichols ..... A47C 12/02 297/118
D347,527 S * 6/1994 Breen ..... D6/349
5,577,806 A 1/1996 Ugalde
6,212,706 B1 * 4/2001 Rossman ..... A47D 11/00 4/572.1
6,886,660 B2 5/2005 Sapatova
D570,125 S * 6/2008 Gonzalez ..... D6/350
D600,929 S * 9/2009 Kemnitzer ..... D6/353
D606,768 S * 12/2009 Tu ..... D6/350
D650,185 S * 12/2011 Hsu ..... D6/349
D650,600 S * 12/2011 Hsu ..... D6/349
8,197,103 B2 * 6/2012 Chang ..... G02B 5/0215 362/333
D743,091 S * 11/2015 Degrandis ..... D26/125
D749,864 S * 2/2016 Cohen ..... D6/692.1
9,307,879 B2 4/2016 Fagre
(Continued)

OTHER PUBLICATIONS

[No Author Listed] Rolling Step Stool—Black, Model No. H-7846BL. Uline. https://www.uline.com/Product/Detail/H-7846BL/Ladders/Rolling-Step-Stool-Black?pricode=WB8203&gadtype=pla&id=H-7846BL&gclid=EAIaIQobChMlrOCd9pLj4wIVBVYMCh2rbgiyEAQYAvABEgLkBPD_BwE&gclsrc=aw.ds , publicly available at least as early as Aug. 4, 2019, 1 page.

*Primary Examiner* — Daniel P Cahn
*Assistant Examiner* — Shiref M Mekhaeil
(74) *Attorney, Agent, or Firm* — Wolf, Greenfield & Sacks, P.C.

(57) ABSTRACT

Treads are provided which allow a stepping surface to be made of a rubber, plastic, or other gripping material while limiting or eliminating recesses or corners that are difficult to clean. Concentric rings of alternating hills and valleys are provided on a top surface of a step. The hills and valleys are wide, have limited slopes, and reduce abrupt directional changes in the surfaces. A user can clean the surface easily with a sponge, towel, mop, or other cleaning tool because the cleaning surface can reach most or all of the tread surface.

16 Claims, 4 Drawing Sheets

(56) References Cited

U.S. PATENT DOCUMENTS

| | | | | |
|---|---|---|---|---|
| D797,645 | S * | 9/2017 | Nishii | D12/400 |
| 9,895,036 | B2 | 2/2018 | Edwards et al. | |
| 10,123,669 | B2 | 11/2018 | Edwards | |
| D839,009 | S * | 1/2019 | Garbus | D6/349 |
| 2003/0217889 | A1* | 11/2003 | Sapatova | A47C 12/02 182/33 |
| 2008/0251317 | A1* | 10/2008 | Johnson | A47C 12/00 182/120 |
| 2008/0251319 | A1* | 10/2008 | Meyers | E06C 1/397 182/152 |
| 2011/0209946 | A1* | 9/2011 | Leng | E06C 1/393 182/129 |
| 2012/0084909 | A1* | 4/2012 | Dunn | A47K 11/06 4/483 |
| 2013/0192925 | A1* | 8/2013 | Chitayat | A47C 12/00 182/152 |
| 2015/0322717 | A1* | 11/2015 | Gibson | A47C 12/00 182/210 |
| 2018/0363374 | A1* | 12/2018 | Woodward | E06C 1/393 |
| 2019/0191886 | A1* | 6/2019 | Hinson | A47C 12/00 |
| 2020/0216624 | A1* | 7/2020 | Hamilton | B29C 45/0013 |
| 2021/0169228 | A1* | 6/2021 | Yang | A47C 12/00 |

* cited by examiner

STEP STOOL WITH TREAD

FIELD

Aspects of the present disclosure relate generally to step stools with treads, and more particularly to step stool with treads which provide grip and are easy to clean.

DISCUSSION OF THE RELATED ART

Many step stools include a tread on the step surface(s) to reduce the risk of slipping. Some of the treads are formed of a rubber material.

SUMMARY

According to one aspect, a step stool includes a first step having a first tread as a top surface, and one or more support members configured to be placed on a floor surface and to support and stabilize the first step above the floor surface. The first tread includes a first plurality of alternating elongated hills and valleys adjacent to one another along a top surface of the first tread. For each valley of the first plurality of elongated valleys, a slope of an imaginary line from a bottom of the valley to a peak an adjacent hill is less than 0.25 along a direction perpendicular to an elongation direction of the adjacent peak. For each valley of the first plurality of elongated valleys, a slope of an imaginary line from a bottom of the valley to a top of an adjacent peak does not exceed 0.5 along any portion of the imaginary line.

According to another aspect, a step stool includes a first step having a first tread as a top surface, and one or more support members configured to be placed on a floor surface and to support and stabilize the first step above the floor surface. The tread includes a first plurality of alternating elongated hills and valleys adjacent to one another, and a perpendicular cross-section of two or more of the plurality of alternating elongated hills and valleys has a top surface with a sinusoidal shape.

According to a further aspect, a step stool includes a first step having a first tread as a top surface, and one or more support members configured to be placed on a floor surface and to support and stabilize the first step above the floor surface. The first tread comprises a first plurality of alternating elongated hills and valleys adjacent to one another along a top surface of the first tread. Each of the hills of the first plurality of alternating elongated hills has a continuously curved shape in a direction perpendicular to a direction of elongation of the hill. A first peak of a first elongated hill of the first plurality of alternating elongated hills and valleys is positioned a first distance from a second peak of a second adjacent elongated hill of the first plurality of alternating elongated hills and valleys. A first bottom of a first elongated valley of the first plurality of alternating elongated hills and valleys is positioned a second distance from a second bottom of a second elongated valley of the first plurality of alternating elongated hills and valleys. The first elongated valley is positioned between the first and second elongated hills, and the second elongated valley is positioned adjacent to the second elongated hill. The first distance is no more than 10% different than the second distance.

According to another aspect, a method of manufacturing a step stool includes affixing a tread to a step of a step stool. The tread includes a first step having a first tread as a top surface, and one or more support members configured to be placed on a floor surface and to support and stabilize the first step above the floor surface. The first tread comprises a first plurality of alternating elongated hills and valleys adjacent to one another along a top surface of the first tread. For each valley of the first plurality of elongated valleys, a slope of an imaginary line from a bottom of the valley to a peak an adjacent hill is less than 0.25 along a direction perpendicular to an elongation direction of the adjacent peak. For each valley of the first plurality of elongated valleys, a slope of an imaginary line from a bottom of the valley to a top of an adjacent peak does not exceed 0.5 along any portion of the imaginary line.

BRIEF DESCRIPTION OF DRAWINGS

Aspects of the invention are described below, by way of example, with reference to the accompanying drawings in which like numerals reference like elements, and wherein.

DETAILED DESCRIPTION

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Various embodiments are described in connection with a step stool having treads overmolded onto steps. However, the present disclosure is not necessarily so limited, and the treads may be employed on surfaces other than stepstools. For example, the treads disclosed herein may be used on floor mats. For ease of understanding, the treads are described in connection with a step stool having two steps, though step stools with only one step may be used, or step stools with three or more steps.

The present disclosure relates to step stool treads which provide desirable grip for a user while permitting easy cleaning of the treads. Step stools often have treads to increase friction between the step(s) of the stool and the bottom of the user's foot or footwear. For some conventional step stools, a gritty layer resembling sandpaper is attached to each step to provide friction. In other step stools, the tread is formed with closely spaced vertical fins made of stiff or flexible rubber or plastic. While both approaches can provide desirable friction characteristics, cleaning the treads can be difficult. In the case of rubber materials, the presence of gaps, corners, slots, etc. can be difficult to access with a sponge or towel or other typical cleaning implements.

According to the present disclosure, treads are provided which allow the surface to be made of a rubber, plastic, or other gripping material while limiting or eliminating recesses or corners that are difficult to clean. According to one arrangement, concentric rings of alternating hills and valleys are provided on a top surface of a step. The hills and valleys are wide, have limited slopes, and reduce abrupt directional changes in the surfaces. As such, a user can clean the surface easily with a sponge, towel, mop, or other cleaning tool because the cleaning surface can reach most or all of the tread surface. In step stools that have grip protrusions that form right angle walls with a tread surface base, the ninety degree corners can be difficult to clean.

By including protruding hills, the step stool treads disclosed herein can provide not only frictional resistance to lateral movement of user's foot, but also provide a physical blocking to lateral movement when an edge of a shoe is positioned within a valley.

Figure 1:
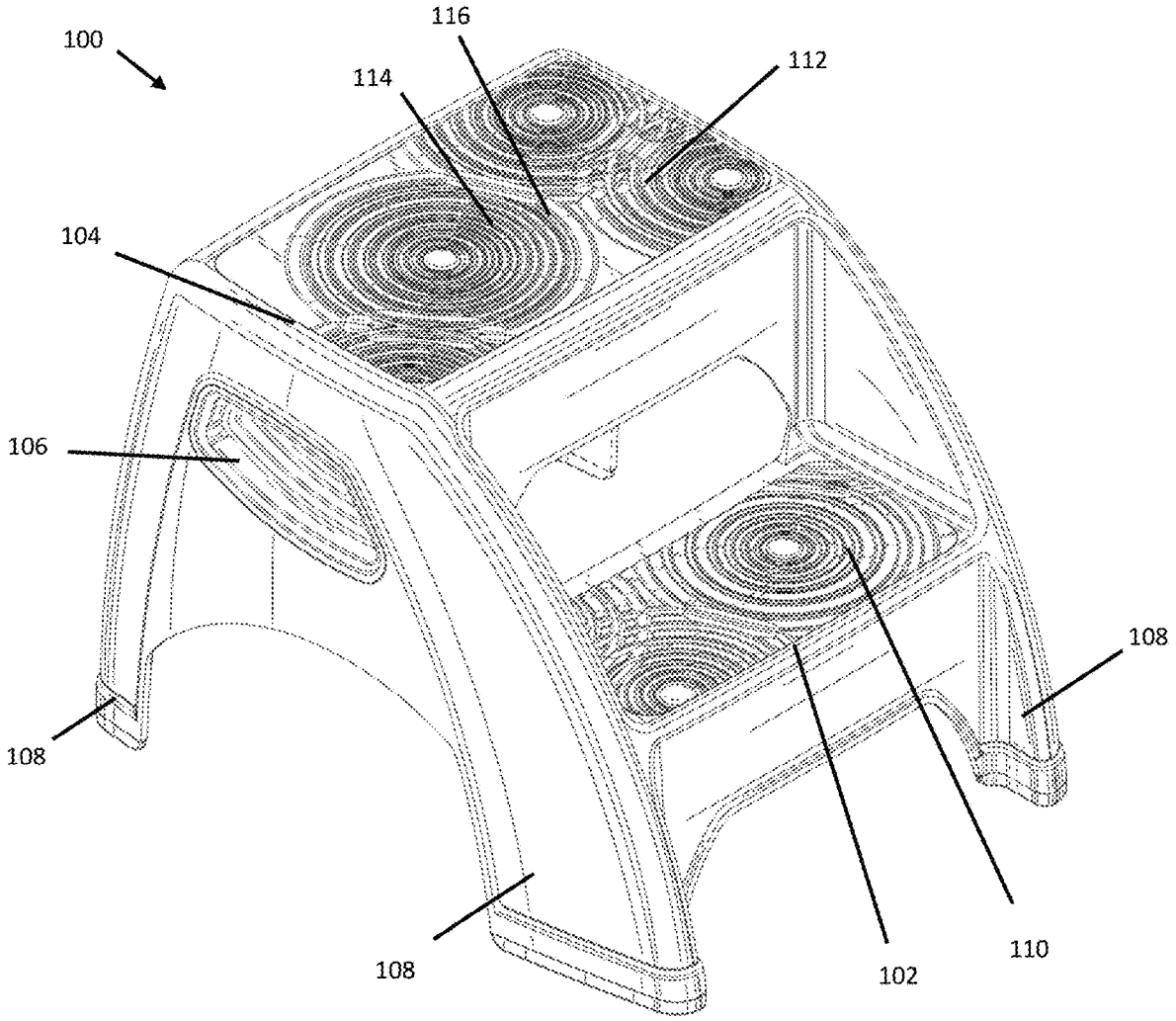
FIG. 1 is a top, front, left side perspective view of a step stool according to one embodiment of the present disclosure.

Turning to the figures, FIG. 1 show a step stool 100 with a first step 102 and a second step 104. A recessed handle 106 is shown on one side of the stool, and a similar handle may be provided on the other side of the stool. The stool includes four legs 108, though any suitable type of support member or members may be used to support and stabilize the stool. For example, in some embodiments, the step stool may be a round, rolling stool with a circular base, and include wheels. The wheels may recede into the stool when a user steps on the stool, at which point an outer rim of the stool base may primarily support the stool on the floor.

In the illustrated embodiment, the step stool is made of injection-molded plastic with overmolded treads. In other embodiments, the step stool may be made of any suitable material(s). For example, a folding step stool made substantially of steel or aluminum may incorporate aspects of the present disclosure.

The first step 102 includes a first tread 110, and the second step 104 includes a second tread 112 according to the present disclosure. Second tread 112 has alternating hills 114 and valleys 116, which are shown in greater detail in FIGS. 2 and 3.

Figure 2:
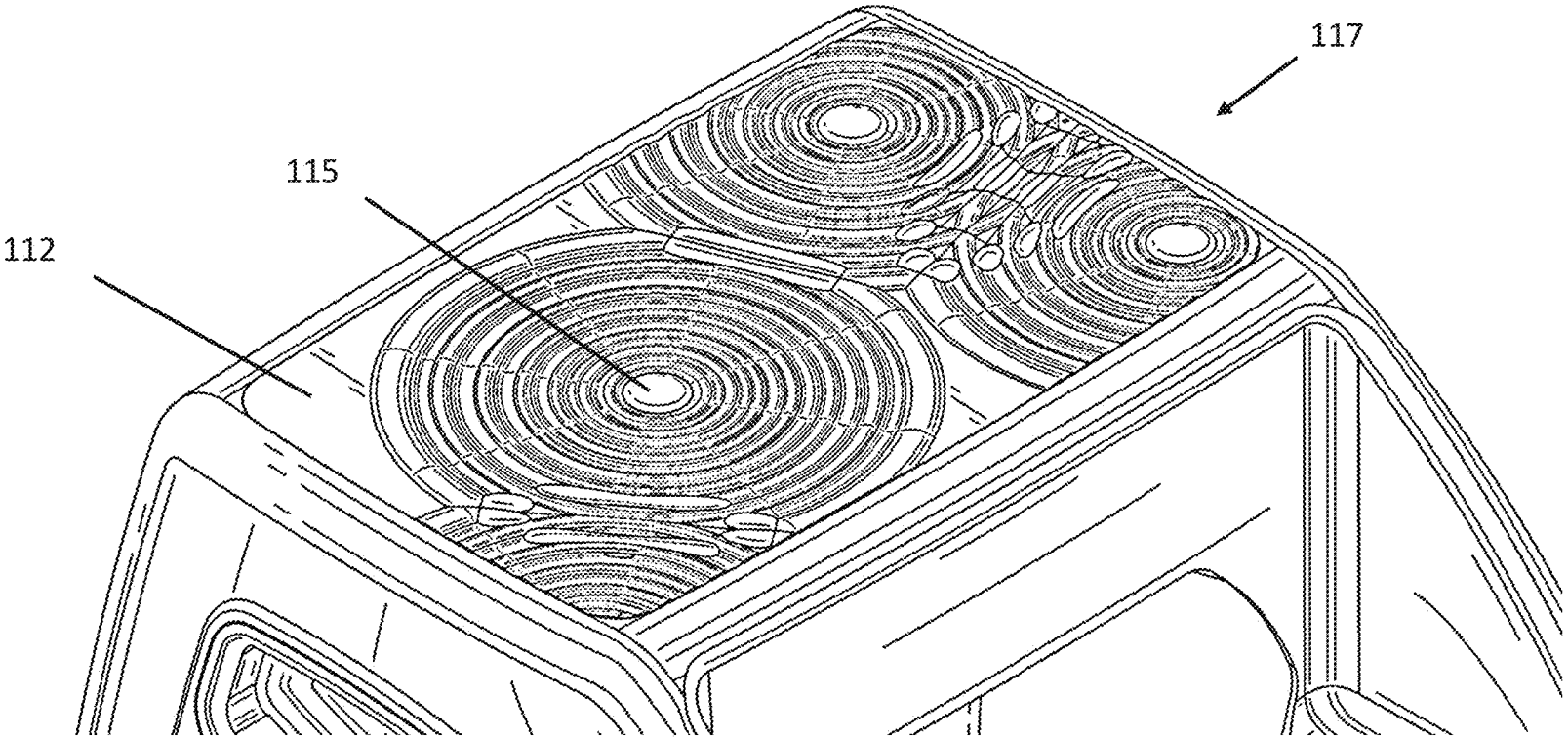
FIG. 2 is a perspective view of a tread according to one embodiment.

As visible in FIG. 2, the treads include features with a wave appearance in the illustrated embodiment, where a sinusoidal-shaped contour emanates from a center area 115. In some embodiments, multiple wave features are include on the same tread, such as shown in FIG. 2, where four partial or complete features are shown. The features may intersect with each other, and may imitate interfering waves 117 in their appearance some embodiments.

Figure 3:
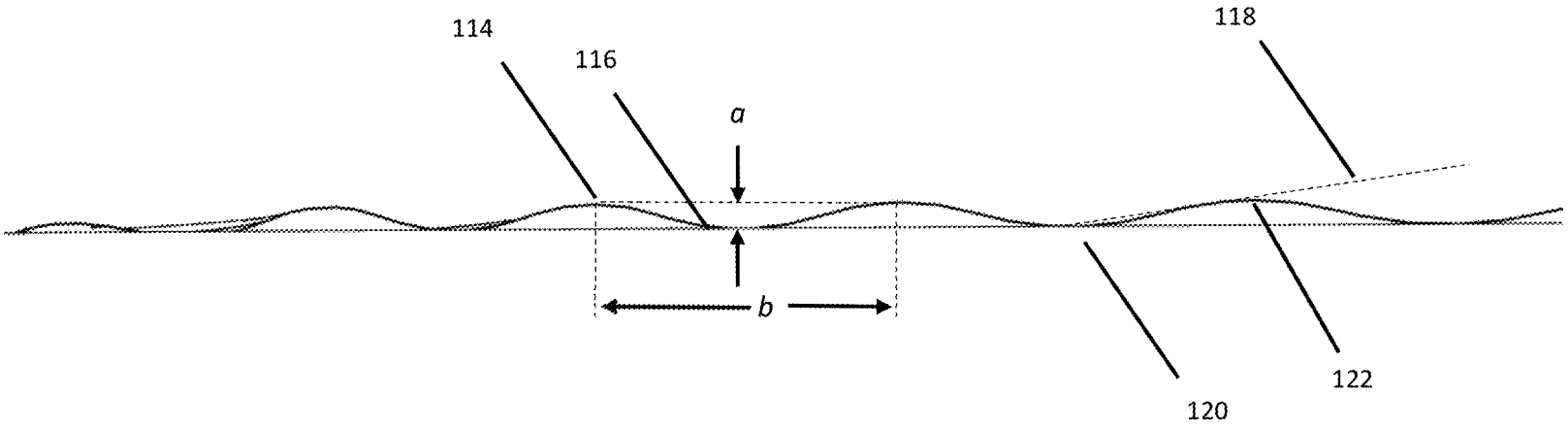
FIG. 3 shows a cross-section of a portion of a tread according to one embodiment.

FIG. 3 shows a cross-sectional view of a portion of second tread 112 from FIG. 2. This view is illustrative of how a cross-section of one of the grip features forms a top grip surface with gently undulating hills 114 and valleys 116. In some embodiments, the shape is a sinusoidal curve.

By limiting or avoiding corners or abrupt direction changes in the surface, cleaning of the surface may be easier as compared to surfaces with tight spaces or corners. The valley walls have shallow slopes. For example, in some embodiments, the slope of an imaginary line 118 from a valley bottom 120 to a peak 122 may be 0.2 or less. In some embodiments, the slope is 0.15 or less. In some embodiments, the slope is between 0.1 and 0.2. In some embodiments, the slope is between 0.05 and 0.15. In some embodiments, the slope is less than 0.25. In some embodiments, Additionally, the slope of the valley wall at all points on the wall may be less than a certain value, such as less than 0.2, less than 0.25, or less than 0.5, as several examples.

The shape of the grip feature shown in FIG. 3 does not have any flat surfaces. Even as the surface passes over a peak 114, the rate of change in the slope of the surface (the second derivative) is less than zero. In other embodiments, the grip feature may include flat surfaces. For example, in some embodiments, the valley floor may include a flat surface and/or a top surface of the peak may include a flat surface. Additionally, as shown in FIGS. 1 and 2, portions of the treads may have flat areas without protrusions and recesses. If the lowest point in a valley falls within a flat area, the bottom of the valley is considered to be the point that is closest to (or at) the mid-point between the two adjacent peaks. If the lowest point in a valley does not fall within a flat area, then the bottom is considered to be the lowest point.

The distances between adjacent peaks may be constant within a grip feature. Or, as would be described using wave terminology, the period may be constant. In other embodiments, such as the embodiment illustrated in FIG. 3, the distances between adjacent peaks may vary. For example, as the peaks become farther away from the middle of the pattern, the distances between the peaks may increase. In other embodiments, the peaks that are farther from the pattern middle may be closer to adjacent peaks as compared to the peaks which are closer to the middle.

The heights of the peaks may be consistent within a wave pattern and even among all the wave patterns on a tread. However, in some embodiments, the peak heights may vary within a wave pattern and/or as between wave patterns on the tread. For grip features that are not shaped to appear as wave patterns, the heights of the peaks may vary across the grip features, or the peaks may have consistent heights across the grip features.

By having valleys that are not too deep relative to the hills and/or flat surfaces of the tread, cleaning of the tread is facilitated. For example, in some embodiments, the ratio of a) the distance between two adjacent peaks to b) the average height of the two adjacent peaks relative to the valley low point between the peaks is at least eight. Such an arrangement allows access to the surface for cleaning with a typical cleaning implement. In some embodiments, all of the hills and valleys of a grip feature maintain at least a minimum ratio of a to b, such as a ratio of eight for example. In other embodiments a, majority of the hills and valleys of a pattern maintain at least a minimum ratio of a to b, such as a ratio of eight for example.

In other embodiments, the minimum ratio of a to b may be six, ten, twelve, or fourteen.

In some embodiments, each pattern is arranged such that a majority of the peaks of the pattern are spaced at least 10 mm from their adjacent peaks. In some embodiments, the pattern(s) are arranged such that all of the peaks are spaced at least 10 mm from their adjacent peaks. In other embodiments, adjacent peaks may be spaced by at least 12 mm from their adjacent peaks. In some embodiments, adjacent peaks are spaced by between 10 mm and 25 mm apart, and as mentioned above, a first pair of adjacent peaks on a tread or within a same feature on a tread may have the same spacing between them as other pairs of adjacent peaks, or a first pair of adjacent peaks may have a different spacing as compared to all or some of other pairs of adjacent peaks.

The distance between two adjacent peaks may be the same or with ±10% of the distance between two valley bottoms—one valley bottom being between the two adjacent peaks, and the other valley bottom being adjacent one of the two peaks.

According to some embodiments, the height of the valley peaks relative to the adjacent valley floors may be approximately 1.5 mm, between 1 mm and 2 mm, no more than 2 mm, between 1.5 mm and 3 mm, or between 1 mm and 1.5 mm.

In an alternative embodiment, the valley portions of a pattern may have a smooth contour with no corners, while the peaks may have a corner at the top. In this manner, the valleys can be reached for cleaning without inaccessible portions formed by concave corners, and the convex corners of the peaks also do not present a cleaning challenge.

The curvature of the hills and valley as seen from the top view (circular in FIGS. 1-2) may also aid with cleaning in some embodiments. In other embodiments, the shape of the hills and valleys are not circular, but may include straight lines, sharp corners, rounded corners, or other shapes.

Figure 4:
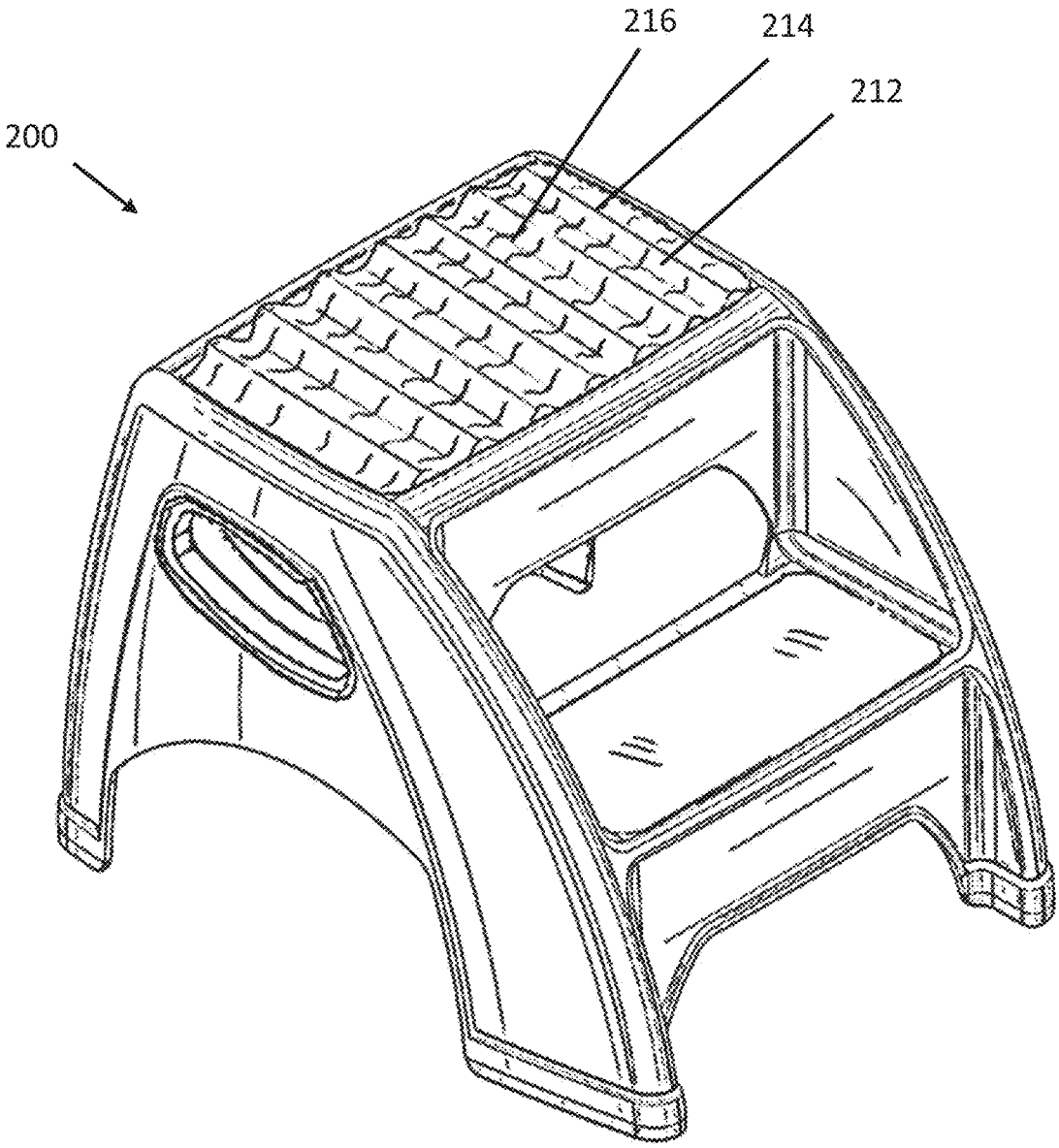
FIG. 4 is a perspective view of a tread according to an alternative embodiment.

For example, as shown by way of example in FIG. 4, a step stool 200 may include sinusoidal wave shapes across a tread 212 with straight hills 214 and valleys 216 which are parallel to each other. The hills and valleys may extend front to back as shown, or side to side, or diagonally. The wave shapes are shown as larger relative to the step stool in FIG. 4 than in the embodiments with circular wave patterns, but in other embodiments, the size of the waves in the straight line pattern may be similar to the size of the waves in the circular patterns.

The middle of a wave pattern does not necessarily have to be a geometric middle of the waves surrounding the middle. The middle can represent the approximate region where the waves would have originated if formed by dropping an object into liquid.

The hills and valleys described herein do not require that the hills protrude higher than a base surface of the associated step, or that the valleys are recessed below a base surface of the associated step, though in some embodiments such an arrangement may be provided.

The tread or treads may be made of thermoplastic elastomer rubber in some embodiments. The tread may be overmolded onto the stool. Other suitable materials and methods of manufacture may be used. For example, the tread may be formed separately from the stool and then adhered to the stool.

For purposes of this patent application and any patent issuing thereon, the indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

The use of "including," "comprising," "having," "containing," "involving," and/or variations thereof herein, is meant to encompass the items listed thereafter and equivalents thereof as well as additional items.

It should also be understood that, unless clearly indicated to the contrary, in any methods claimed herein that include more than one step or act, the order of the steps or acts of the method is not necessarily limited to the order in which the steps or acts of the method are recited.

The foregoing description of various embodiments are intended merely to be illustrative thereof and that other embodiments, modifications, and equivalents are within the scope of the invention recited in the claims appended hereto.

What is claimed is:

1. A step stool comprising:

a first step having a first tread as a top surface of the first step; and one or more support members configured to be placed on a floor surface and to support and stabilize the first step above the floor surface;

wherein the first tread comprises a first plurality of alternating elongated hills and elongated valleys adjacent to one another along the top surface of the first step;

wherein, for each first elongated valley of the first plurality of elongated valleys, a slope of an imaginary line from a bottom of a respective first elongated valley to a peak of an adjacent first elongated hill of the first plurality of elongated hills is less than 0.25 along a direction perpendicular to an elongation direction of the peak of the adjacent first elongated hill; and wherein, for each first elongated valley of the first plurality of elongated valleys, a slope of a first valley wall is less than 0.5 at all points on the first valley wall;

wherein the first tread comprises a second plurality of alternating elongated hills and elongated valleys adjacent to one another along the top surface of the first step;

wherein, for each second elongated valley of the second plurality of elongated valleys, a slope of an imaginary line from a bottom of a respective second elongated valley to a peak of an adjacent second hill of the second plurality of elongated hills is less than 0.25 along a direction perpendicular to an elongation direction of the peak of the adjacent second elongated hill;

wherein, for each second elongated valley of the second plurality of elongated valleys, a slope of a second valley wall of each second valley is less than 0.5 at all points on the second valley wall;

an elongation direction of each of the second elongated hills and second elongated valleys of the second plurality of elongated hills and valleys is curved; and the first plurality of elongated hills and valleys intersects the second plurality of elongated hills and valleys such that a first elongated hill of the first plurality of elongated hills and elongated valleys interrupts a second elongated valley of the second plurality of elongated hills and elongated valleys.

2. The step stool of claim 1, wherein a perpendicular cross-section of two or more of the first plurality of alternating elongated hills and elongated valleys has a sinusoidal shape.

3. The step stool of claim 1, wherein, for each first elongated valley of the first plurality of elongated valleys, the slope of the imaginary line from the bottom of the first elongated valley to the peak of the adjacent first elongated hill is less than 0.20 along the direction perpendicular to the elongation direction of the peak of the adjacent first elongated hill.

4. The step stool of claim 1, wherein each of the first elongated hills and first elongated valleys of the first plurality of elongated hills and elongated valleys form a partial circle or a full circle.

5. The step stool of claim 1, wherein each of the first elongated hills and first elongated valleys of the first plurality of elongated hills and elongated valleys form rings.

6. The step stool of claim 1, wherein each of the first elongated hills and first elongated valleys of the first plurality of elongated hills and elongated valleys form concentric rings.

7. The step stool of claim 1, wherein the elongation direction of each of the first elongated hills and first elongated valleys of the first plurality of elongated hills and elongated valleys is curved.

8. The step stool of claim 1, wherein each of the first elongated hills and first elongated valleys of the first plurality of elongated hills and elongated valleys form a partial circle or a full circle, and each of the second elongated hills and second elongated valleys of the second plurality of elongated hills and elongated valleys form a partial circle or a full circle.

9. The step stool of claim 1, further comprising a complete circle at a middle of the first plurality of elongated hills and elongated valleys, the circle having a peak at a center of the circle.

10. The step stool of claim 9, wherein the peak at the center of the circle is taller than peaks of all the first elongated hills of the first plurality of elongated hills and elongated valleys.

11. The step stool of claim 1, wherein the tread is formed of a thermoplastic elastomer.

12. The step stool of claim 1, further comprising a second step having a second tread as a top surface of the second step;

wherein the second tread comprises a third plurality of alternating elongated hills and elongated valleys adjacent to one another along the top surface of the second step;

wherein, for each third elongated valley of the third plurality of elongated valleys, a slope of an imaginary line from a bottom of a respective third elongated valley to a peak of an adjacent third elongated hill of the third plurality of elongated hills is less than 0.25 along a direction perpendicular to an elongation direction of the peak of the adjacent third elongated hill; and wherein, for each third elongated valley of the third plurality of elongated valleys, a slope of a third valley wall is less than 0.5 at all points on the third valley wall.

13. A step stool comprising:

a first step having a first tread as a top surface of the first step;

one or more support members configured to be placed on a floor surface and to support and stabilize the first step above the floor surface, wherein the first tread comprises a first plurality of alternating elongated hills and elongated valleys adjacent to one another along the top surface of the first step, wherein, for each elongated valley of the first plurality of elongated valleys, a slope of an imaginary line from a bottom of a respective elongated valley to a peak of an adjacent elongated hill of the first plurality of elongated hills is less than 0.25 along a direction perpendicular to an elongation direction of the peak of the adjacent elongated hill, wherein, for each elongated valley of the first plurality of elongated valleys, a slope of a first valley wall is less than 0.5 at all points on the first valley wall; and a complete circle at a middle of the first plurality of elongated hills and valleys, the circle having a peak at a center of the circle, wherein the peak at the center of the circle is taller than peaks of all the elongated hills of the first plurality of elongated hills and elongated valleys.

14. The step stool of claim 13, wherein a perpendicular cross-section of two or more of the first plurality of alternating elongated hills and elongated valleys has a sinusoidal shape.

15. The step stool of claim 13, wherein, for each elongated valley of the first plurality of elongated valleys, the slope of the imaginary line from the bottom of the elongated valley to the peak of the adjacent elongated hill is less than 0.20 along the direction perpendicular to the elongation direction of the peak of the adjacent elongated hill.

16. The step stool of claim 13, wherein the elongation direction of each of the elongated hills and elongated valleys of the first plurality of elongated hills and elongated valleys is curved.

* * * * *